US010039392B2

(12) United States Patent
Servutas

(10) Patent No.: US 10,039,392 B2
(45) Date of Patent: Aug. 7, 2018

(54) MODULAR POSTER PRINT STRETCH FRAME

(71) Applicant: Vitali Servutas, Virginia Beach, VA (US)

(72) Inventor: Vitali Servutas, Virginia Beach, VA (US)

( * ) Notice: Subject to any disclaimer, the term of this patent is extended or adjusted under 35 U.S.C. 154(b) by 0 days.

(21) Appl. No.: 15/193,695

(22) Filed: Jun. 27, 2016

(65) Prior Publication Data

US 2017/0367504 A1 Dec. 28, 2017

Related U.S. Application Data

(63) Continuation of application No. 15/190,845, filed on Jun. 23, 2016.

(51) Int. Cl.

| | |
|---|---|
| ***A47G 1/06*** | (2006.01) |
| ***A47G 1/08*** | (2006.01) |
| ***B44D 3/18*** | (2006.01) |

(52) U.S. Cl.

CPC ..... *A47G 1/065* (2013.01); *A47G 1/08* (2013.01); *B44D 3/185* (2013.01); *A47G 2001/0661* (2013.01)

(58) Field of Classification Search

CPC .. A47G 1/065; A47G 1/08; A47G 2001/0661; B44D 3/185

See application file for complete search history.

(56) References Cited

U.S. PATENT DOCUMENTS 451,607 A * 5/1891 Holmes ..... B44D 3/185 16/16
1,305,121 A * 5/1919 Klimowicz ..... G09F 7/08 40/605

(Continued)

FOREIGN PATENT DOCUMENTS

CN 201499913 U 6/2010
CN 104116358 A 10/2014

(Continued)

OTHER PUBLICATIONS

"Economy Metal Frames", Framing 4 Yourself inc, Accessed on Jun. 22, 2016, URL:http://www.framing4yourself.com/shop/products/custom-sectional-metal-frames/.

(Continued)

*Primary Examiner* — Gary C Hoge
(74) *Attorney, Agent, or Firm* — Maier & Maier, PLLC

(57) ABSTRACT

A modular poster print stretch frame for displaying a variety of sizes of poster prints. The modular poster print stretch frame may comprise a plurality of modular frame sections, each having a section body and two or more connectors disposed on at least two faces of the section body, each connector being configured to link the modular frame section to at least one other modular frame section. Modular frame sections may also include a plurality of retaining structures which may be used to retain a fabric sheet, such as a poster print. Some or all of the modular frame sections may be substantially identical to and interchangeable with each other, allowing for simple and easy assembly of the modular poster print stretch frame to a variety of sizes.

19 Claims, 8 Drawing Sheets

(56) References Cited

U.S. PATENT DOCUMENTS 1,421,301 A * 6/1922 Petrow ..... A47G 1/08 40/741
2,819,549 A * 1/1958 Tester ..... A47G 1/08 40/739
3,830,278 A * 8/1974 Packer ..... B44D 3/185 160/378
4,115,938 A 9/1978 Belmuth et al.
4,144,660 A * 3/1979 Lamb ..... B44D 3/185 160/378
4,151,665 A * 5/1979 Gibby ..... B44D 3/185 160/404
4,255,886 A * 3/1981 Klarman ..... B44D 3/185 160/379
4,519,151 A * 5/1985 Johnson ..... B44D 3/185 160/374.1
4,729,183 A 3/1988 Tarter et al.
4,922,638 A 5/1990 Litvak et al.
5,515,630 A * 5/1996 Maher ..... A47G 1/08 40/739
5,546,689 A 8/1996 Bomze
5,579,596 A * 12/1996 Kovacs ..... A47G 1/08 40/739
5,588,240 A 12/1996 Zilliox
5,624,118 A * 4/1997 Gottesman ..... A63F 9/1044 273/157 R
6,237,270 B1 * 5/2001 Kovar ..... A47G 1/0616 40/725
6,253,471 B1 * 7/2001 Strauh ..... B44D 3/185 160/381
6,347,466 B1 * 2/2002 Lackner ..... B44D 3/185 38/102
2003/0208934 A1 * 11/2003 Ocampo ..... G09F 15/0025 38/12
2006/0042141 A1 3/2006 Hansen et al.
2006/0059758 A1 * 3/2006 Zacharias ..... A47G 1/10 40/782
2008/0209787 A1 * 9/2008 Alcov ..... A47G 1/08 40/742
2009/0013577 A1 * 1/2009 Barnard ..... A47G 1/065 40/731
2010/0162602 A1 * 7/2010 Da Ponte Moreira Rato ..... B44D 3/185 40/711
2011/0056106 A1 * 3/2011 Bosma ..... B44D 3/185 40/700
2011/0203753 A1 * 8/2011 Domingue ..... B44D 3/185 160/378
2012/0066945 A1 3/2012 Cook et al.
2014/0026456 A1 * 1/2014 Pirayesh ..... A47G 1/0605 40/741
2014/0047747 A1 2/2014 Jackson

FOREIGN PATENT DOCUMENTS

CN 204363566 U 6/2015
KR 100797450 B1 1/2008

OTHER PUBLICATIONS

Notification of Transmittal of the International Search Report and the Written Opinion of the International Searching Authority dated Sep. 4, 2017, in connection with corresponding international application No. PCT/US2017/036716 (15 pgs.).

* cited by examiner

MODULAR POSTER PRINT STRETCH FRAME

BACKGROUND

Fabric poster prints and photo prints have seen a recent increase in popularity, and have been becoming increasingly ubiquitous as displays in homes, offices, or other locales. Improvements in printer technology have made fabric poster prints and photo prints relatively inexpensive and high-quality, making them increasingly attractive as an option. Many also appreciate the different aesthetics and display methods that may be possible with a fabric poster or photo print. For example, fabric poster or photo prints can be, and often are, displayed as a "gallery wrap," a type of display method that entails stretching the print around the sides of a frame so that the frame is hidden and the print appears to be displayed framelessly. Some fabric poster or photo prints may even be formed around a nonrectangular, or even irregularly-shaped or three-dimensional, frame, such as is done in "shaped canvas" painting.

Many traveling researchers, sales professionals, and other business professionals have also appreciated the travel-related benefits of fabric poster and photo prints for their presentation visual aids or other visual displays. One key benefit is that such displays can be easily folded and placed in luggage without the risk of creasing the fabric poster or photo print, which eliminates the need for the traveling professional to carry around a bulky poster carrying tube as they would traditionally have to.

However, the significant amount of customization potential that is offered by fabric poster and photo printing technology is hampered by the lack of customization innovations in framing techniques for fabric poster and photo prints. Current practices for framelessly displaying fabric poster or photo prints typically require the use of stretcher or strainer bars, which are typically rectangular braces of fixed size that cannot be easily altered once assembled. This limits the sizes and shapes of fabric poster and photo prints that can be framed with a standard frame to those matching the size of the custom frame. Such frames are also often bulky, which causes problems for traveling professionals who may need to transport a display stand or frame that can be used to display their presentation materials.

SUMMARY

According to an exemplary embodiment, a modular poster print stretch frame may be disclosed. A modular poster print stretch frame may comprise: A modular poster print stretch frame, comprising: a plurality of modular frame sections, each of the modular frame sections comprising a section body and at least two connectors disposed on at least two faces of the section body, each of the connectors being configured to connect the modular frame section to another modular frame section in the plurality of modular frame sections; and a plurality of retaining structures disposed on a plurality of the modular frame sections, the plurality of retaining structures being configured to retain a fabric sheet; wherein a plurality of the modular frame sections in the plurality of modular frame sections are substantially identical to and interchangeable with at least one other modular frame section in the plurality of modular frame sections.

According to another exemplary embodiment, a method for displaying a poster print using a modular poster print stretch frame may be disclosed. Such a method may comprise: measuring a poster print; assembling, from a plurality of modular frame sections, a modular poster print stretch frame, each of the modular frame sections comprising: a section body; at least two connectors disposed on at least two faces of the section body, each of the connectors being configured to connect the modular frame section to another modular frame section in the plurality of modular frame sections; and a plurality of retaining structures disposed on a plurality of the modular frame sections, the plurality of retaining structures being configured to retain a section of the poster print; wherein a plurality of the modular frame sections in the plurality of modular frame sections are substantially identical to and interchangeable with at least one other modular frame section in the plurality of modular frame sections; and mounting the poster print on the plurality of retaining structures.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

Figure 1A:
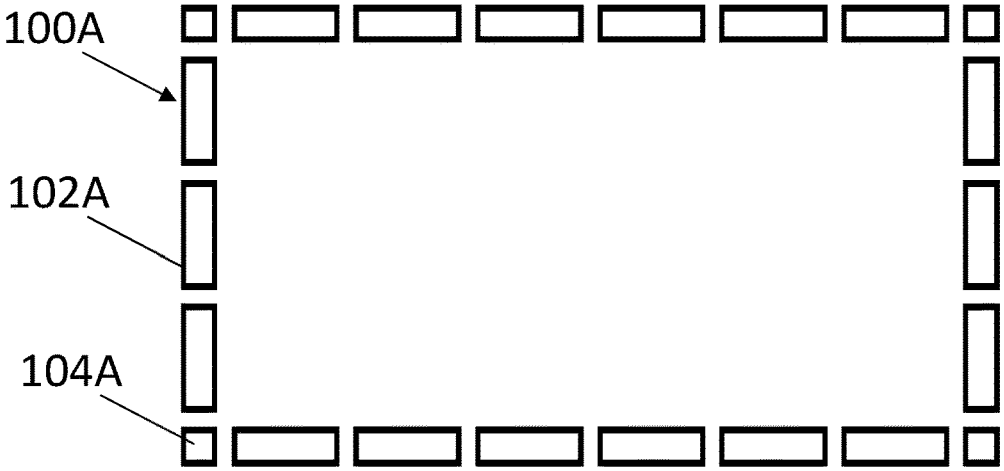
FIG. 1A is an exemplary embodiment of a configuration of a modular poster print stretch frame having a rectangular shape.
Figure 1B:
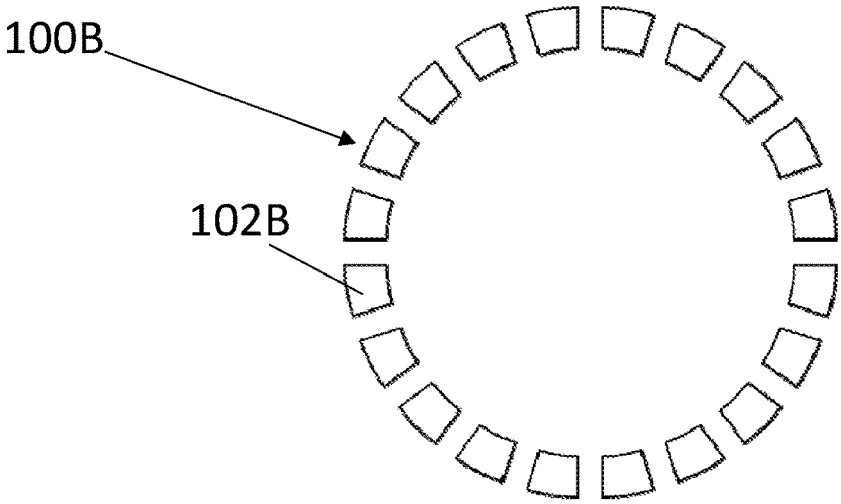
FIG. 1B is an exemplary embodiment of a configuration of a modular poster print stretch frame having a circular shape.
Figure 1C:
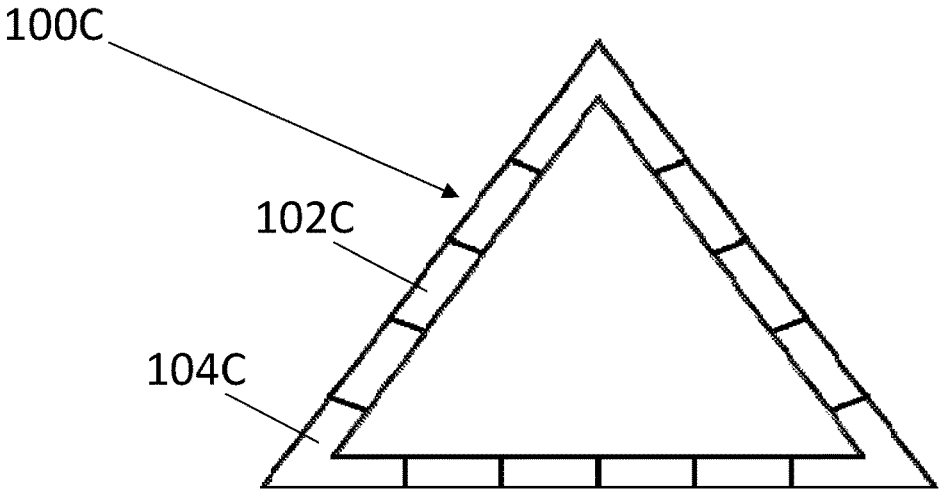
FIG. 1C is an exemplary embodiment of a configuration of a modular poster print stretch frame having a triangular shape.

Turning now to exemplary FIGS. 1A, 1B, and 1C, exemplary embodiments of a modular poster print stretch frame 100A, 100B, and 100C may be displayed.

Turning first to exemplary FIG. 1A, an exemplary embodiment of a modular poster print stretch frame 100A having a rectangular shape may be disclosed. Modular poster print stretch frame may include a number of side pieces 102A that make up each side of the rectangular modular poster print stretch frame 100A, and a number of corner pieces 104A that may be disposed, for example, at each corner of the rectangular modular poster print stretch frame 100A. Each of the side pieces 102A and corner pieces 104A may interlock with other side pieces 102A and corner pieces 104A, such as via a universal connector shared between side pieces 102A and corner pieces 104A. In one exemplary embodiment, a connector may be, for example, a tab-and-slot connector, in which a tab of a side piece 102A or corner piece 104A can fit securely in the slot of another side piece 102A or corner piece 104A, thereby linking the two pieces. Tab-and-slot connector may also be called, for example, a slide-in locking system. In another exemplary embodiment, connectors may be peg-and-hole connectors; side pieces 102A and corner pieces 104A may each have a hole on either side of the body of the piece, and a peg or other fastener, such as a bolt, may be passed through the interlocking holes of two adjacent side pieces 102A or corner pieces 104A, or a side piece 102A and a corner piece 104A, in order to join the two pieces. Other connectors, such as, for example, connectors that use a plurality of tabs and a plurality of slots, or a plurality of holes and a plurality of fasteners, or any other connector configuration, as desired, may also be used.

According to an exemplary embodiment, side pieces 102A and/or corner pieces 104A may have more than two connectors, and may, for example, have multiple connectors on each side, which may be disposed in a plurality of orientations. For example, a side piece 102A may have connectors disposed in each axial direction, as well as connectors near each of its ends on either of the long sides. This may allow side pieces 102A to be connected to other pieces in such a manner that the connection causes a 90 degree bend in the frame, which may allow the frame to be assembled without specific corner pieces 104A. According to another exemplary embodiment, connectors between side pieces 102A and/or corner pieces 104A may be adjustable.

According to an exemplary embodiment, side pieces 102A may all be the same size as other side pieces 102A, and corner pieces 104A may all be the same size as other corner pieces 104A. This may, for example, ensure that the side pieces 102A and the corner pieces 104A may be interchanged with other like pieces, ensuring, for example, that the modular poster print stretch frame 100A is easy to assemble. According to another exemplary embodiment, at least one of the side pieces 102A and the corner pieces 104A may come in different sizes. For example, according to an exemplary embodiment, the side pieces 102A may be provided in a number of lengths, for example 1", 2", 4", 6", 12", 24", 36", and 48", as well as any other lengths, as desired. This may ensure that the modular poster print stretch frame 100A can be formed in a variety of sizes, based on the demands of a particular poster or photo print to be displayed on the frame 100A. In some exemplary embodiments, side pieces 102A may not be straight, and may bend or curve; for example, in one exemplary embodiment, the side pieces 102A may have a shallow sinusoidal wave shape to create a border effect, or may have some other shape, as desired. Alternatively, side pieces 102A or corner pieces 104A may be adjustable; for example, in one exemplary embodiment, side pieces 102A may be expandable or contractable to some degree in order to vary their length.

According to another exemplary embodiment, corner pieces 104A may be formed at different angles. For example, according to an exemplary embodiment, corner pieces 104A may be formed at 90 degrees, 135 degrees, and 45 degrees, which may allow the modular poster print stretch frame 100A to be formed in other shapes, such as right triangle shapes and trapezoidal shapes, as desired. According to another exemplary embodiment, the angles formed by the corner pieces 104A of the modular poster print stretch frame 100A may be adjustable to one of multiple potential angles.

Turning now to exemplary FIG. 1B, an exemplary embodiment of a modular poster print stretch frame 100B having a circular shape may be disclosed. Modular poster print stretch frame may include a number of radial pieces 102B that make up the circumference of the circular modular poster print stretch frame 100B. As in FIG. 1A, the pieces of the frame, including the radial pieces 102B, may differ in size and shape, or may all be identically sized and shaped, as desired, and may interlock with each other to form the frame. According to an exemplary embodiment, a modular poster print stretch frame 100B may also have an elliptical shape, or may have another shape, as desired.

Turning now to exemplary FIG. 1C, an exemplary embodiment of a modular poster print stretch frame 100C having a triangular shape may be disclosed. Modular poster print stretch frame may include a number of side pieces 102C that make up each side of the rectangular modular poster print stretch frame 100C, and a number of corner pieces 104C that may be disposed, for example, at each corner of the triangular modular poster print stretch frame 100C. As in FIG. 1A, the pieces of the frame, including the side pieces 102C and the corner pieces 104C, may differ in size and shape, or may all be identically sized and shaped, as desired. In an exemplary embodiment, the angles formed by each of the corner pieces 104C may be adjustable.

According to another exemplary embodiment, other shapes of a modular poster print stretch frame other than those disclosed above as 100A, 100B, and 100C may be envisioned. For example, according to an exemplary embodiment, a modular poster print stretch frame may have a trapezoidal shape, or may have any other shape in which side pieces 102A, 102B, 102C and corner pieces 104A, 104B, 104C can be arranged in a closed loop in which each side piece 102A, 102B, 102C and/or corner piece 104A, 104B, 104C is connected to exactly two other side pieces 102A, 102B, 102C or corner pieces 104A, 104B, 104C. According to another exemplary embodiment, a modular poster print stretch frame may have any other two-dimensional or three-dimensional shape, as desired. According to an exemplary embodiment, pieces from different shapes may utilize a universal connector, and a user may be able to form, for example, a semicircular frame shape from the pieces of a rectangular 100A and a circular 100B modular poster print stretch frame, as desired.

According to an exemplary embodiment, modular poster print stretch frames 100A, 100B, 100C may be formed from any material, such as wood, plastic, metal, or silicone, or any other material, as desired. According to an exemplary embodiment, modular poster print stretch frames 100A, 100B, 100C may be rigid or may be substantially flexible.

Figure 2:
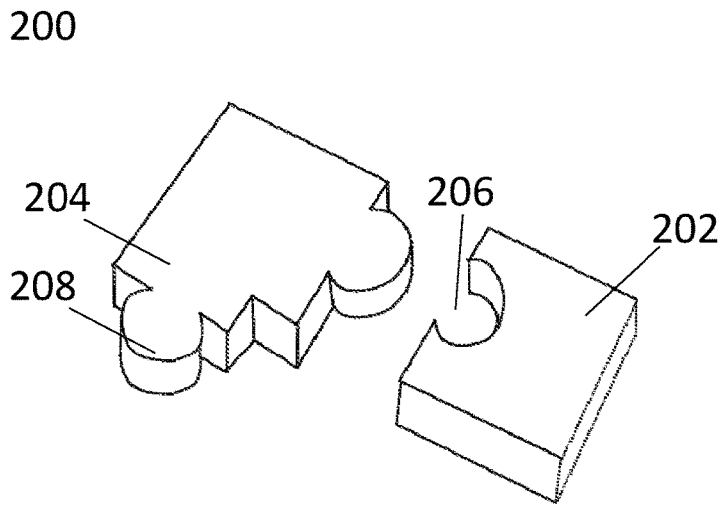
FIG. 2 is an exemplary embodiment of a portion of a modular poster print stretch frame.

Turning now to exemplary FIG. 2, an exemplary embodiment of a portion of a modular poster print stretch frame 200 may be disclosed. Modular poster print stretch frame 200 may include, for example, one or more corner pieces 204 and one or more side pieces 202. According to an exemplary embodiment, corner pieces 204 and side pieces 202 may use a tab-and-slot connector system; for example, according to one exemplary embodiment, corner pieces 204 may include a plurality of slots 206 or tabs 208 disposed on two adjoining faces of the corner piece 204, and side pieces 202 may include a plurality of slots 206 or tabs 208 disposed on two non-adjoining faces of the side piece 202. The tabs 208 and the slots 206 of the corner pieces 204 and side pieces 202 may interlock with each other, as desired.

According to an exemplary embodiment, the cross-sections of the corner pieces 204 or the side pieces 202 may be any shape. For example, according to an exemplary embodiment, the cross-section of a side piece 202 may be rectangular. According to another exemplary embodiment, the cross-section of a side piece 202 may be an oval. The cross-sections of the corner pieces 204 or the side pieces 202 may also vary, as desired.

Figure 3:
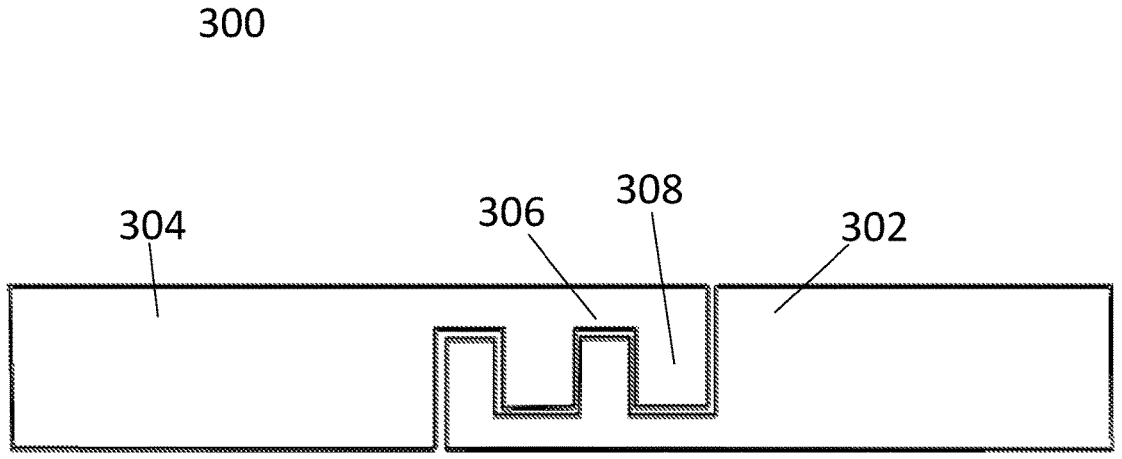
FIG. 3 is an exemplary embodiment of a modular poster print stretch frame.

Turning now to exemplary FIG. 3, an exemplary embodiment of a modular poster print stretch frame 300 may be disclosed. Modular poster print stretch frame 300 may include, for example, one or more corner pieces 304 and one or more side pieces 302. According to an exemplary embodiment, corner pieces 304 and side pieces 302 may use a tab-and-slot connector system; for example, according to one exemplary embodiment, both corner pieces 304 and side pieces 302 may include connectors having a plurality of slots 306 and tabs 308, and which may interlock with the connectors of other corner pieces 304 and side pieces 302.

Figure 4A:
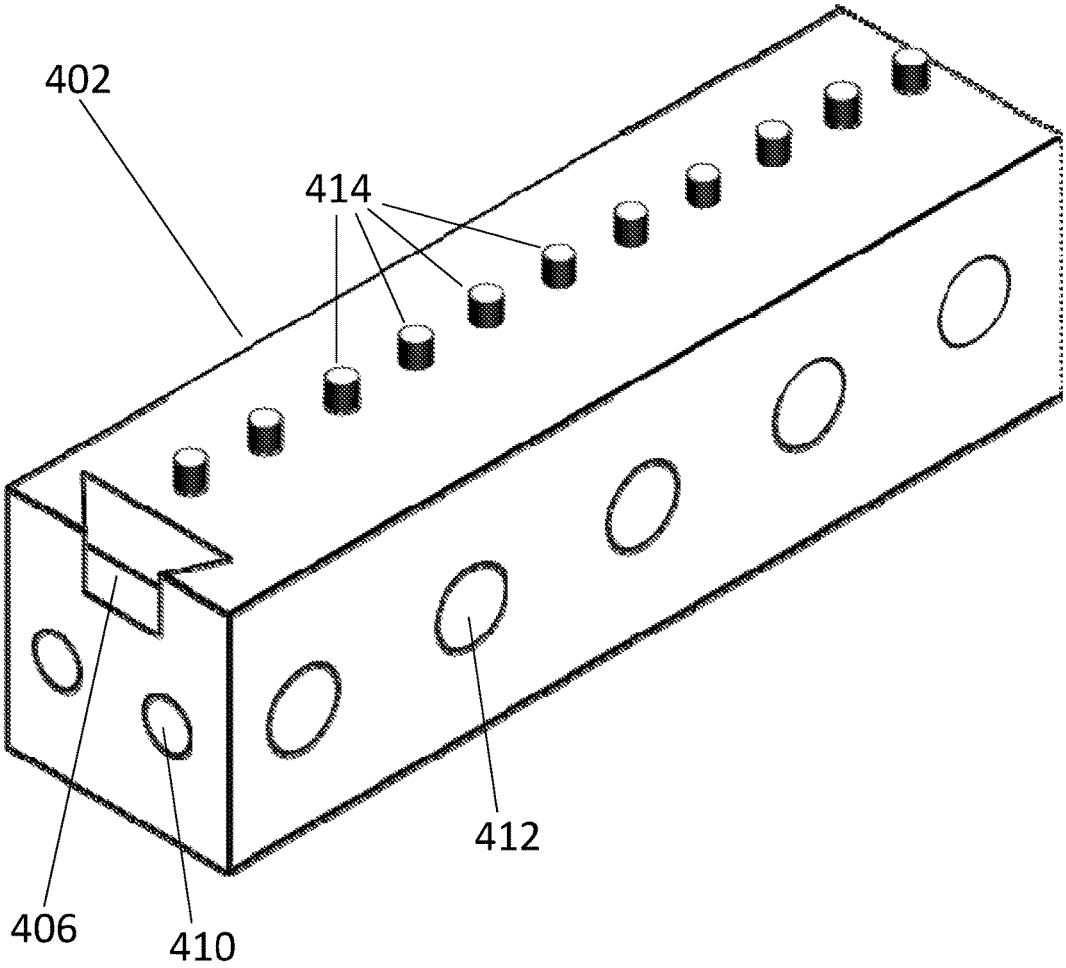
FIG. 4A is an exemplary embodiment of a side piece of a modular poster print stretch frame.

Turning now to exemplary FIG. 4A, an exemplary embodiment of a side piece 402 of a modular poster print stretch frame may be disclosed. According to an exemplary embodiment, side piece 402 may include part of a tab-and-slot connector system, for example the slot. Other exemplary embodiments of side pieces 402 or other pieces may include, for example, a tab sized to fit within a slot 406. Alternatively, according to an exemplary embodiment, tab may be a separate insert that may link adjoining slots 406 of adjoining side pieces 402, as desired.

According to an exemplary embodiment, a side piece 402, or other piece, may include one or more stabilizing holes 410. According to an exemplary embodiment, stabilizing holes 410 may be disposed in the same plane as a connector, for example the slot 406. Stabilizing holes 410 may accommodate one or more pegs, which may join a stabilizing hole 410 in one side piece 402 to a stabilizing hole 410 in an adjoining piece, such as an adjoining side piece 402. According to another exemplary embodiment, certain pieces, such as certain side pieces 402, may have one or more protrusions in place of stabilizing holes 410, and adjoining pieces may be linked by inserting the protrusions of one piece into the stabilizing holes 410 of the adjoining piece.

According to an exemplary embodiment, a side piece 402 or other piece may include one or more support frame mounting holes 412. According to an exemplary embodiment, a support frame or other support system may be required to support a fabric poster or photo print that has been mounted on a modular poster print stretch frame; in an exemplary embodiment, support frame mounting holes 412 may be sized to accommodate such a support frame or other support system, as desired. According to an exemplary embodiment, support frame mounting holes 412 may be shallow or deep, may be flat, angled or curved, may be threaded, or may have any other shape, as desired.

According to an exemplary embodiment, a side piece 402 or other piece may have a plurality of projections 414 along one or more faces on which a fabric poster or photo print may be mounted. According to an exemplary embodiment, projections 414 may be arranged linearly or substantially linearly, and may be arranged in the axial direction of the side piece 402. In an exemplary embodiment, a fabric poster or photo print may have a plurality of holes substantially the same size as the projections 414 disposed along one or more edges of the fabric poster or photo print; in such an embodiment, the projections 414 may be placed through the holes of the fabric poster or photo print in order to secure the fabric poster or photo print to the modular poster print stretch frame.

According to an exemplary embodiment, the cross-sections of projections 414 may be substantially identical and substantially circular. According to another exemplary embodiment, the cross-sections of projections 414 may be triangular, square or rectangular, or another shape, as desired. According to another exemplary embodiment, the sizes, or shapes, of cross-sections of projections 414 may vary; for example, the projections 414 may be larger near the center of a side piece 402 or may be larger on certain pieces, such as certain side pieces 402, than they are on other pieces, or may be shaped differently on certain pieces or certain parts of pieces, as desired.

According to an exemplary embodiment, projections 414 may function alongside other geometry of the side piece 402 or other piece in order to retain a fabric poster or photo print. For example, according to an exemplary embodiment, a side piece 402 may have one or more clamps, clasps, or other fasteners on one or more faces of the side piece 402, which may function to better retain the fabric poster or photo print. According to another exemplary embodiment, a side piece 402 may have a retaining groove or other geometry configured to secure the fabric poster or photo print. According to another exemplary embodiment, side piece 402 may only have another type of fastener or retaining structure, and no projections 414 may be present. According to another exemplary embodiment, external fasteners, such as external clamps not part of the side piece 402, may be used instead.

Figure 4B:
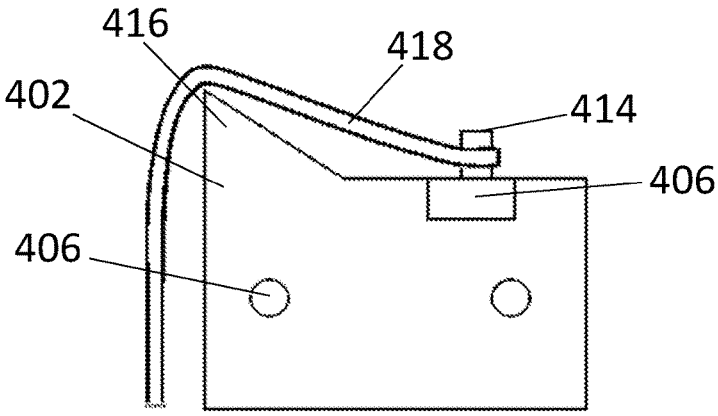
FIG. 4B is an exemplary embodiment of a side piece of a modular poster print stretch frame.

Turning now to exemplary FIG. 4B, FIG. 4B shows a variant of the exemplary embodiment of FIG. 4A, with the exemplary embodiment of a side piece 402 disclosed in FIG. 4B having a lip 416 along one edge. In an exemplary embodiment, the fabric poster or photo print 418 may be stretched around the lip 416, and may then be affixed to the projections 414. When the modular poster print stretch frame is assembled, a fabric poster or photo print 418 is placed around the lip 416 of a particular side piece 402, and the modular poster print stretch frame is hung against a wall, the lip 416 may pin the fabric poster or photo print 418 to the wall, helping to secure it in place.

In an embodiment, the lip 416 may be taller than the projections 414 and may be used to hide the projections 414 from view. For example, according to an exemplary embodiment, the modular poster print stretch frame may be formed such that, when assembled, the lip 416 and the projections 414 of a side piece both face the wall, with the lip 416 running along the outside of the modular poster print stretch frame, the lip 416 being formed to rest flush with the wall.

This may ensure that, when a viewer looks at the outside of the modular poster print stretch frame, they see only the lip 416 and not the projections 414. Lip 416 may also be used to prevent the projections 414 from being damaged; for example, the lip 416 may keep the projections 414 spaced slightly apart from any wall or surface that it is mounted on, preventing any force from being exerted on the projections 414 by the wall and preventing damage from occurring to the projections 414 while the modular poster print stretch frame is being mounted.

Figure 4C:
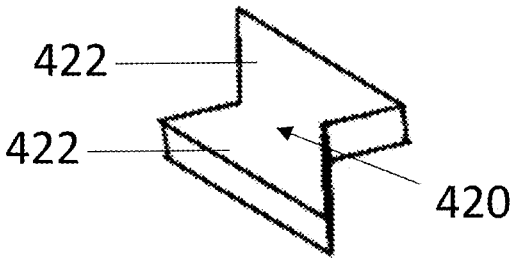
FIG. 4C is an exemplary embodiment of an insert configured to fit in a slot of a side piece of a modular poster print stretch frame.

Turning now to exemplary FIG. 4C, FIG. 4C shows an exemplary embodiment of an insert 420 that may link adjoining slots 406 of adjoining pieces. The insert may have a plurality of ends 422, each of which is adapted to fit within one of the adjoining slots 406 of the adjoining pieces.

Figure 4D:
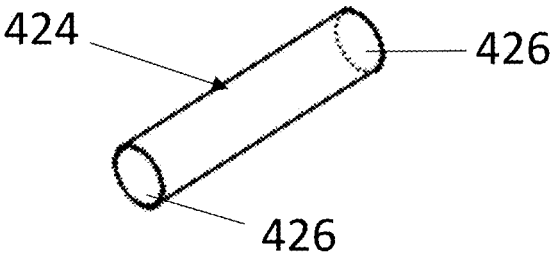
FIG. 4D is an exemplary embodiment of a peg configured to fit in a hole of a side piece of a modular poster print stretch frame.

Turning now to exemplary FIG. 4D, FIG. 4D shows an exemplary embodiment of a peg 424, which may join a stabilizing hole 410 in one side piece 402 to a stabilizing hole 410 in an adjoining piece, such as an adjoining side piece 402. The peg may have a plurality of ends 426, each of which is adapted to fit within one of the stabilizing holes 410 of the adjoining pieces.

Figure 4E:
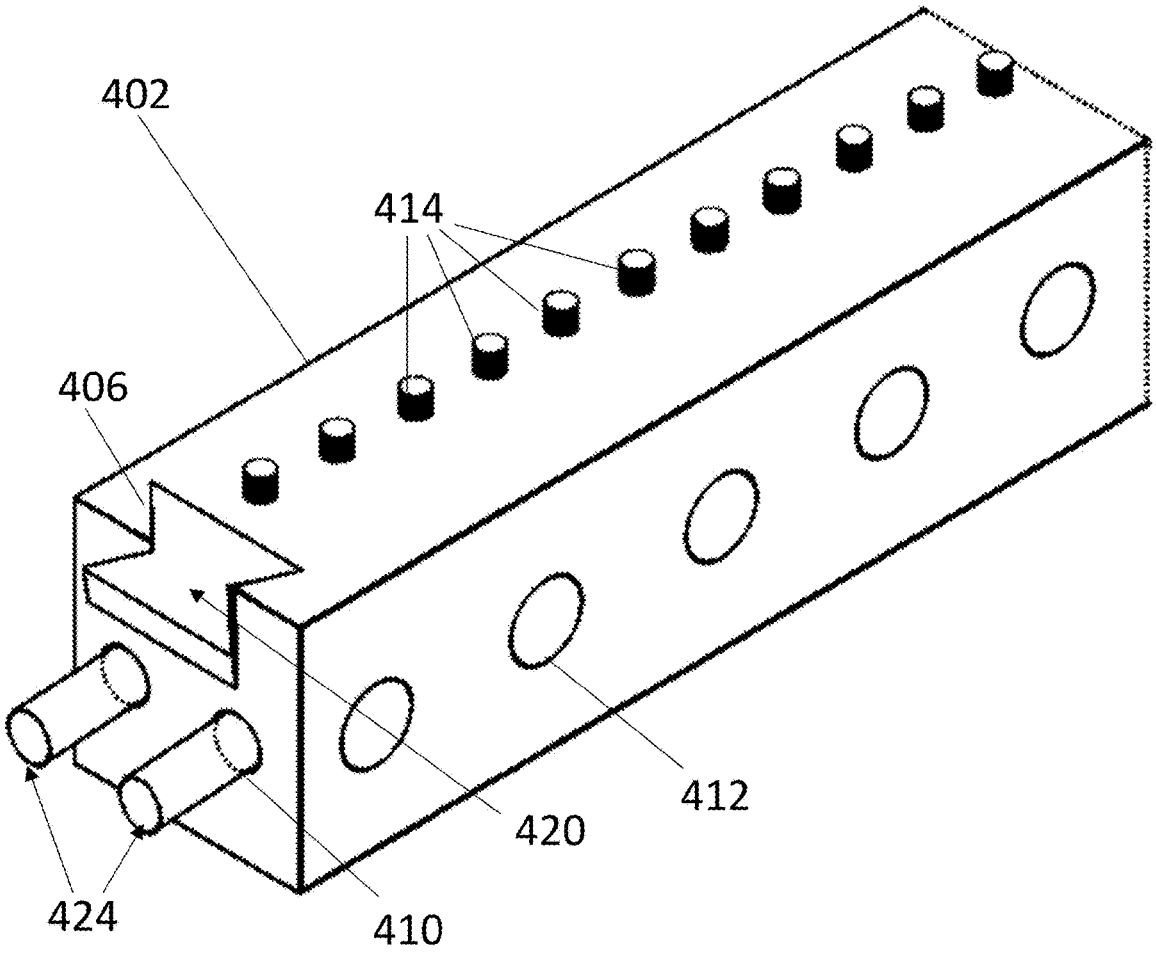
FIG. 4E is an exemplary embodiment of a side piece of a modular poster print stretch frame having an insert and a plurality of pegs coupled thereto.

Turning now to exemplary FIG. 4E, FIG. 4E shows an exemplary embodiment of a side piece 402 of a modular poster print stretch frame, having an insert 420 disposed in a slot 406 and a plurality of pegs 424, each disposed in a stabilizing hole 410.

Figure 5:
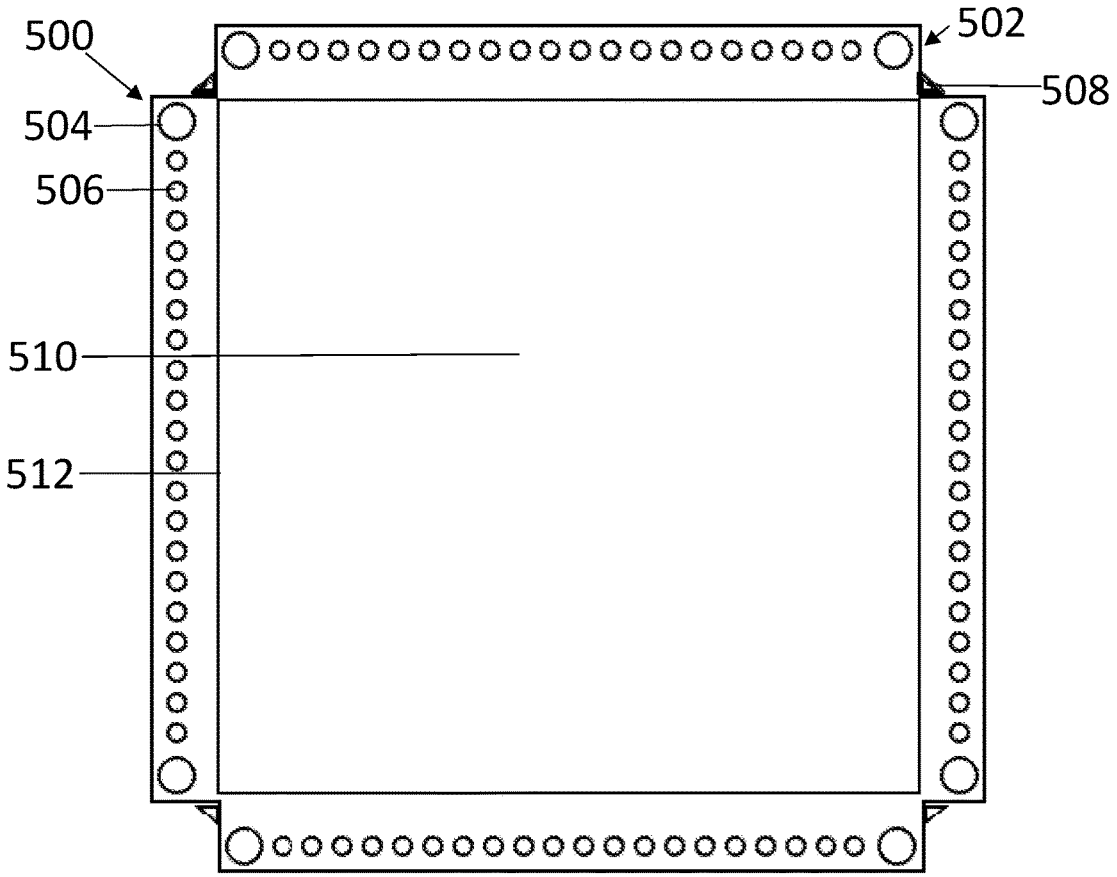
FIG. 5 is an exemplary embodiment of a fabric photo or poster print that may be adapted to be held on a modular poster print stretch frame.

Turning now to exemplary FIG. 5, FIG. 5 shows an exemplary embodiment of a fabric photo or poster print 500 that may be adapted to be held on a modular poster print stretch frame, according to one possible configuration of the modular poster print stretch frame. According to an exemplary embodiment, fabric photo or poster print 500 may be rectangular or substantially rectangular, and may have a plurality of flaps 502 that extend outside of the boundaries 512 of the photo or poster image 510 to be displayed. Alternatively, according to an exemplary embodiment, the photo or poster image 510 to be displayed may extend wholly or partially onto the flaps 502, as desired. According to another exemplary embodiment, the fabric photo or poster print 500 may be a shape other than rectangular, such as triangular, circular, or another shape, as desired.

The flaps 502 of the fabric poster or photo print 500 may include a plurality of mounting holes 504, 506 that may be used to mount the fabric poster or photo print 500, for example on a series of projections like those of FIGS. 4A and 4B. According to an exemplary embodiment, mounting holes 504, 506 may be disposed linearly or substantially linearly, and may be arranged to fit over a plurality of pegs or projections also arranged linearly or substantially linearly.

According to an exemplary embodiment, mounting holes 504, 506 may be of any size, and may consistently be the same size or may be of varying sizes; for example, in one exemplary embodiment, mounting holes 504 near the edges of the flaps 502 may be larger than mounting holes 506 nearer the center of the flaps 502, and the projections that the mounting holes 504, 506 are configured to fit on or over may be similarly sized. According to another exemplary embodiment, the mounting holes 504, 506 may have any shape, and may be, for example, circular, rectangular, triangular, or another shape, as desired. Mounting holes 504, 506 may also have multiple shapes; for example, in one exemplary embodiment, all of the mounting holes 504, 506 may be either circular or elliptical, whereas in another exemplary embodiment, some of the mounting holes 504 may be triangular while others are rectangular 506.

According to an exemplary embodiment, the flaps 502 of the fabric poster or photo print 500 may include tabs 508 that may be used to bridge the gap between flaps 502 when the fabric poster or photo print 500 is folded. For example, according to an exemplary embodiment, a fabric poster or photo print 500 may be affixed to a rectangular frame by first affixing a top and bottom set of flaps 502 to a set of projections located on the top and bottom of the frame. Each of the top and the bottom flaps 502 may have a pair of tabs 508, with one tab 508 being disposed on either side of the flap 502. To continue affixing the fabric poster or photo print 500 to the frame, the side flaps 502 may then be folded over these tabs 508 and affixed to another set of projections located on each side of the frame. This may cause the tabs 508 to become tucked under the side flaps 502, which may create an illusion of continuity of the folded fabric poster or photo print 500 when attached to the frame, and may prevent the exposure of parts of the frame through gaps in the fabric poster or photo print 500.

Figure 6:
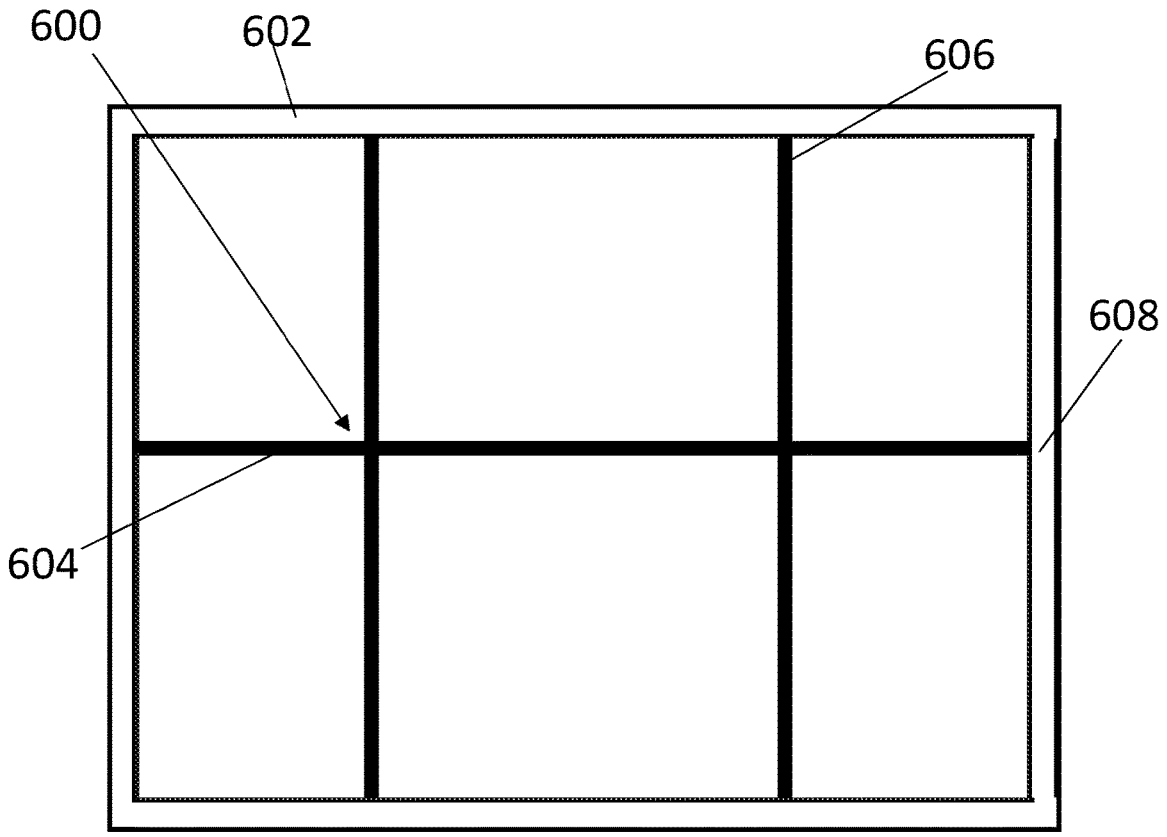
FIG. 6 is an exemplary embodiment of a frame support system that may be added to a modular poster print stretch frame.

Turning now to exemplary FIG. 6, FIG. 6 shows an exemplary embodiment of a frame support system 600 that may be added to a modular poster print stretch frame 602. According to an exemplary embodiment, the frame support system 600 may fit inside a modular poster stretch frame 602, and may stiffen it and provide additional support to prevent sagging, cracking, or breaking of the modular poster print stretch frame 602.

According to an exemplary embodiment, frame support system 600 and modular poster print stretch frame 602 may be rectangular. According to an exemplary embodiment, a rectangular frame support system 600, or another frame support system 600, may include one or more horizontal supports 604 and one or more vertical supports 606. According to another exemplary embodiment, frame support system 600 may include other orientations of supports, as desired.

In an exemplary embodiment, the frame support system 600 may be wholly or partially held in place by a plurality of support frame mounting holes 608, such as the support frame mounting holes of FIGS. 4A and 4B. The tips of the elements 604, 606 of the frame support system 600 may mirror the support frame mounting holes 608, and vice-versa; for example, according to an exemplary embodiment wherein the tips of the elements 604, 606 of the frame support system 600 are threaded, the support frame mounting holes 608 may also be threaded.

Figure 7:
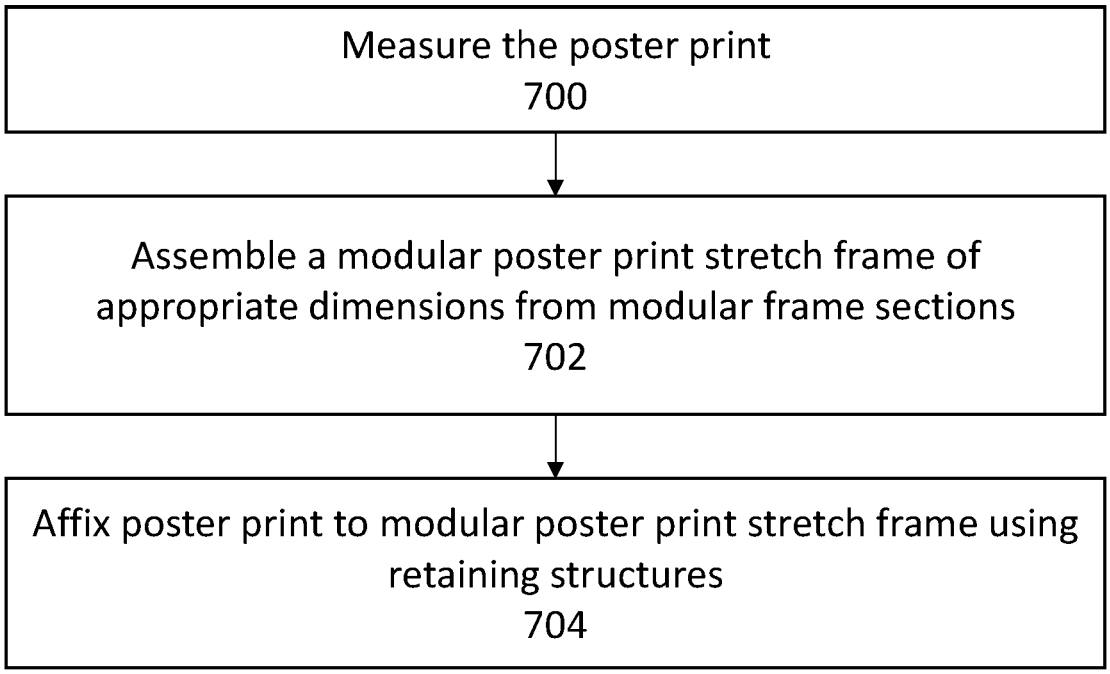
FIG. 7 is a flowchart displaying an exemplary method of displaying a poster print.

Turning now to exemplary FIG. 7, a flowchart displaying an exemplary method of displaying a poster print may be disclosed. A user may first measure the poster print 700, in order to determine how many modular frame sections are necessary to construct a frame of appropriate size. A user may then assemble the modular poster print stretch frame to have the appropriate dimensions 702, and may mount the poster print to the modular poster print stretch frame using its retaining structures 704. Optionally, a user may add a frame support system or other structure to provide additional support for the modular poster print stretch frame, if desired.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art (for example, features associated with certain configurations of the invention may instead be associated with any other configurations of the invention, as desired).

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A modular poster print stretch frame, comprising:

a plurality of modular frame sections, each of the modular frame sections consisting of a single part and comprising a section body and at least two connectors disposed on at least two faces of the section body and integrally formed on the at least two faces of the section body so as to provide a continuous material formation, each of the connectors being configured to connect the modular frame section to another modular frame section in the plurality of modular frame sections; and a plurality of retaining structures disposed on a plurality of the modular frame sections, the plurality of retaining structures being configured to retain a fabric sheet; wherein the retaining structures disposed on a plurality of the modular frame sections comprise raised projections disposed on a rearward side of the modular poster print stretch frame, and wherein the raised projections are configured to interface with and retain flexible display material on the rearward side of the modular print stretch frame;

wherein a plurality of the modular frame sections in the plurality of modular frame sections are substantially identical to and interchangeable with at least one other modular frame section in the plurality of modular frame sections.

2. The modular poster print stretch frame of claim 1, wherein the modular poster print stretch frame comprises a closed loop formed from the connection of each modular frame section in the plurality of modular frame sections to two other modular frame sections in the plurality of frame sections.

3. The modular poster print stretch frame of claim 2, wherein the closed loop is rectangular in shape.

4. The modular poster print stretch frame of claim 2, wherein the closed loop forms a two-dimensional shape.

5. The modular poster print stretch frame of claim 2, wherein the closed loop forms a three-dimensional shape, the three-dimensional shape varying in each of the length, width, and height directions.

6. The modular poster print stretch frame of claim 1, wherein the raised projections are arranged substantially linearly.

7. The modular poster print stretch frame of claim 1, wherein each of the raised projections has a cross-section selected from one of the set of: circular, rectangular, triangular.

8. The modular poster print stretch frame of claim 1, wherein the raised projections vary in cross-section.

9. The modular poster print stretch frame of claim 1, further comprising a plurality of lips disposed on a plurality of the modular frame sections, each lip comprising a contiguous raised portion disposed apart from the raised projections and along an edge of one of the plurality of modular frame sections, wherein each of the lips is disposed on the rearward side of the modular poster print stretch frame, and wherein each of the lips is taller than the raised projections.

10. The modular poster print stretch frame of claim 1, wherein the connectors comprise at least one of: tab-and-slot connectors, or peg-and-hole connectors.

11. The modular poster print stretch frame of claim 1, wherein the connectors comprise slots in which an insert may be disposed, and wherein the modular poster print stretch frame further comprises a plurality of inserts, each of the inserts being adapted to simultaneously fit within a plurality of slots.

12. The modular poster print stretch frame of claim 11, wherein each of the slots comprises a trapezoidal recess, the trapezoidal recess defined by a long base, a short base, and a first leg and a second leg connecting the long base and the short base, the short base arranged along a narrow edge of the modular frame section and the long base extending parallel to the short base, the trapezoidal recess further defined by a plurality of planar sidewalls extending downward from the long base, the first leg, and the second leg, the trapezoidal recess further defined by a trapezoidal recess lower surface extending parallel to a top face of the section body.

13. The modular poster print stretch frame of claim 11, wherein each of the plurality of inserts has an hourglass shape comprising a first trapezoid having a long base and a short base and a second trapezoid having a long base and a short base, the first trapezoid and the second trapezoid being joined at their respective short bases.

14. The modular poster print stretch frame of claim 1, wherein each of the plurality of modular frame sections further has a plurality of stabilizing holes, and wherein at least one of the plurality of stabilizing holes is formed in the same plane as each of the connectors of the modular frame section.

15. The modular poster print stretch frame of claim 14, further comprising a plurality of pegs, each of the pegs being adapted to simultaneously fit within a plurality of stabilizing holes.

16. The modular poster print stretch frame of claim 1, further comprising a frame support system, the frame support system comprising a plurality of support members.

17. The modular poster print stretch frame of claim 16, wherein a plurality of the modular frame sections in the plurality of modular frame sections further have at least one support frame mounting hole disposed thereupon, and wherein the support members of the frame support system are disposed within one or more of the support frame mounting holes.

18. The modular poster print stretch frame of claim 1, wherein at least one of the plurality of modular frame sections is a side piece, the side piece having at least two faces that run substantially parallel to each other and on which connectors are disposed, and wherein at least one of the plurality of modular frame sections is a corner piece, the corner piece having at least two faces that do not run substantially parallel to each other and on which connectors are disposed.

19. A method of displaying a poster print, comprising:

measuring a poster print;

assembling, from a plurality of modular frame sections, a modular poster print stretch frame, each of the modular frame sections consisting of a single part and comprising:

a section body;

at least two connectors disposed on at least two faces of the section body, each of the connectors being configured to connect the modular frame section to another modular frame section in the plurality of modular frame sections and integrally formed on the at least two faces of the section body so as to provide a continuous material formation; and a plurality of retaining structures disposed on a plurality of the modular frame sections, the plurality of retaining structures being configured to retain a section of the poster print; wherein the retaining structures disposed on a plurality of the modular frame sections comprise raised projections disposed on a rearward side of the modular poster print stretch frame, and wherein the raised projections are configured to interface with and retain flexible display material on the rearward side of the modular print stretch frame;

wherein a plurality of the modular frame sections in the plurality of modular frame sections are substantially identical to and interchangeable with at least one other modular frame section in the plurality of modular frame sections; and mounting the poster print on the plurality of retaining structures.

* * * * *